United States Patent [19]

Schneider et al.

[11] Patent Number: 4,604,856

[45] Date of Patent: Aug. 12, 1986

[54] RELEASABLE AFFIXATION OF ARTICLE OF MANUFACTURE TO AN ENVIRONMENT

[76] Inventors: Donald Schneider, 7515 Cedar Rd., Chesterland, Cuyahoga County, Ohio 44026; Stanley Schneider, 1820 Chartley Rd., Gates Mills, Cuyahoga County, Ohio 44122

[21] Appl. No.: 662,164

[22] Filed: Oct. 18, 1984

[51] Int. Cl.[4] ..... B68B 1/00

[52] U.S. Cl. ..... 54/76; 24/3 L; 63/29 R; 428/83; 428/99; 428/542.2

[58] Field of Search ..... 428/4, 83, 99, 542.2; 63/1 A, 29 R; 24/3 G, 3 J, 3 L; 54/76

[56] References Cited

U.S. PATENT DOCUMENTS

| | | | |
|---|---|---|---|
| 100,728 | 3/1870 | Colton | 2/249 |
| 233,583 | 10/1880 | Waldron | 428/4 X |
| 245,979 | 8/1881 | Sloat | 428/4 X |
| 390,702 | 10/1888 | Pflueger | 428/4 X |
| 1,618,573 | 2/1927 | Cole | 24/3 J |
| 1,652,972 | 12/1927 | Beck | 24/3 L |
| 1,807,100 | 5/1931 | Graff et al. | 24/3 J |
| 2,126,968 | 8/1938 | Mohel | 63/1 A |
| 2,391,420 | 12/1945 | Huber | 428/4 X |
| 2,514,834 | 7/1950 | Bostian | 24/3 G |
| 3,561,066 | 2/1971 | Osteen | 24/3 L |

*Primary Examiner*—Henry F. Epstein
*Attorney, Agent, or Firm*—Jones, Day, Reavis & Pogue

[57] ABSTRACT

An article of manufacture and a method of releasably attaching an article of manufacture to extant means in an environment of intended attachment. The environment of intended attachment includes articles of equine saddlery. The article of manufacture comprises at least two surfaces, one of the surfaces further comprising first means whereby the article may be releasably attached to extant means in the environment of intended attachment, the first means comprising generally U-shaped resilient clip means having a first leg, a second leg, and a joint joining the legs, the first leg being secured to said surface of the article, the second leg extending rearwardly and downwardly from the surface and joint, the extant means in the environment comprising outwardly extending bridging means, at least one of the legs of the first means comprising detent means disposed so as to extend towards the other of said legs and in spaced relationship from the joint, whereby the interior space formed between the first and second legs is divided into at least two longitudinal portions extending substantially parallel to said surfaces, such that the portion between the joint and the detent means is of a longitudinal dimension so as to substantially mate with the extant means in the environment while effecting releasable attachment therewith.

18 Claims, 9 Drawing Figures

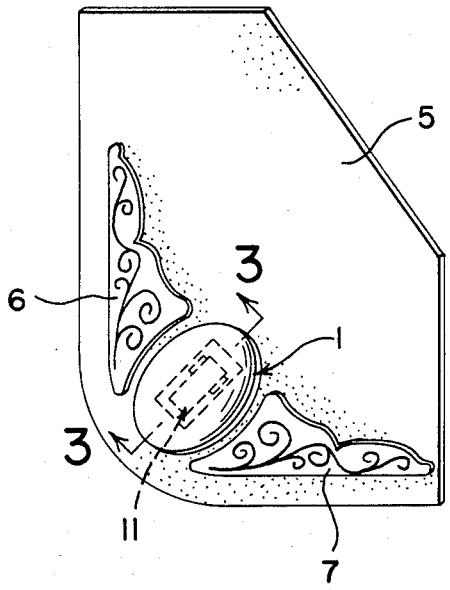
FIG. 1
FIG. 2
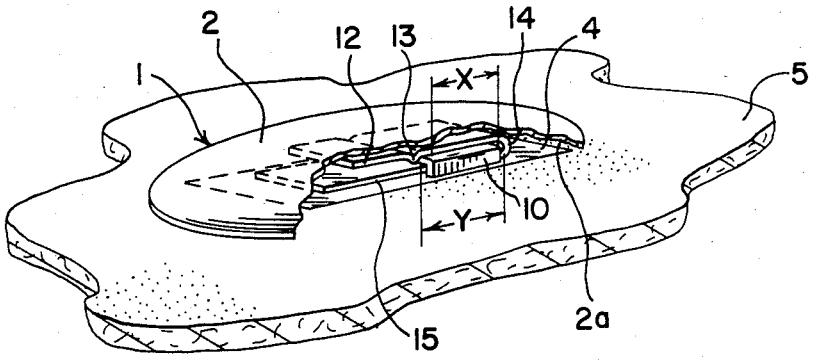

FIG. 4
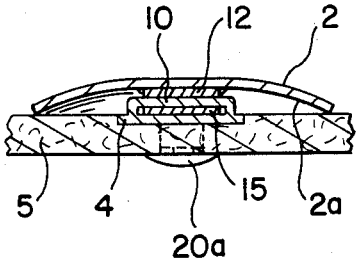
FIG. 3
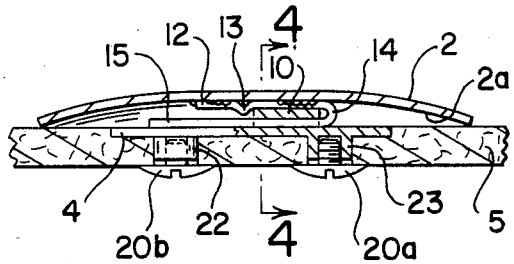
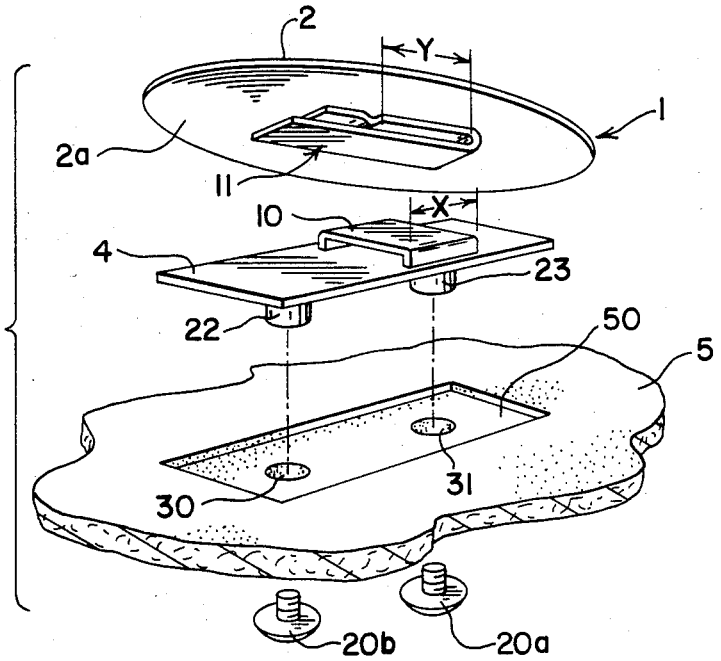
FIG. 5

RELEASABLE AFFIXATION OF ARTICLE OF MANUFACTURE TO AN ENVIRONMENT

BACKGROUND OF THE INVENTION

1. Field of the Invention

This invention relates generally to releasable attachment of articles of manufacture to extant means in an environment, and particularly relates to releasably attaching first articles of manufacture to second articles of manufacture.

2. Description of Related Art Including Information Disclosed Under 37 CFR § 1.97–1.99

The fastening of objects one to the other, and the method for accomplishing same, is an area of endeavor of inestimable antiquity. Most efforts in that area have been directed to permanently securing one object to another, or a multitude of articles together. The familiar nail is undoubtedly one of the earliest means developed to effect that purpose. Rivets are another well-known means of permanent fastening.

Fastening objects together in a non-permanent manner has also been an area of much investigation over the millenia. The familiar screw, in certain contexts, is again an early means of effecting such a non-permanent relationship. Non-permanent fastening, however, presents difficulties not demonstrated in permanent securing. Tools are often necessary to effect joinder and undoing of the joinder of the objects—the screwdriver and the wrench are prime examples. The objects to be joined must be invaded by the fastening means, which protrude from the surface of one or both objects. The head of a screw or the bolt and exposed threads of a nut and bolt combination are familiar examples. The non-permanent fastening means also demonstrate a tendency to come unfastened at other than the desired time, particularly if the environment is subjected to vibration and hard use. This has led to the development of additional means to curve that tendency, ranging from thread compounds to lock washers.

Permanent and non-permanent fastening has had long association with another of man's oldest technologies, the domestication and use, for work and pleasure, of animals—particularly, the horse. Various components forming saddles, tack, bridles, stirrups, halters and the like have been permanently fastened together by tying, stitching, and riveting, among other techniques. When non-permanent fastening has been required, rings and ties, or rings and clips, have been employed.

Saddlery used with horses has also been embellished with various ornaments, medallions, emblems, trim and the like, a practice again having roots in the distant past. Such ornaments have ranged from colored ropes to studs to base metal ornaments to chased silver and gemstone stone combinations. The latter are extremely valuable, particularly in view of current market conditions.

Ornaments have heretofore been attached to saddlery by permanent fastening means, such as rivets or split rivets. While these means function adequately, resisting any loosening through use of the article, they prevent the ornament from being removed when desired. Where a chased silver or other precious metal ornament, or a precious metal and gemstone combination ornament, is at issue, their cost often prohibits ornamenting more than one or two items. Thus, a horse's trappings may not include the desired level and style of ornamentation, and the selection of trappings is thus undesirably limited. Having more than one animal with physical configurations prohibiting interchange of saddlery is also a limit to permanently affixed ornaments. Security and protection of valuables is also difficult—the ornament's affixation to the saddlery requires that the entire object be secured to secure the ornament.

Faced with that problem, the art turned to the use of the post and screw, known as the "Chicago post" or the "Chicago screw." That technique afforded non-permanent fastening of articles to saddlery, with removal being effected through use of the common screwdriver. The saddlery is pierced to allow passage of the posts through to the back side of the article, whereupon the screws are inserted into the posts, which are internally drilled and tapped, and tightened.

While the Chicago post or screw system of attachment of an ornament provided non-permanence and hence removability, it still presented serious drawbacks. Properly tightened and secured once, the screws were still slightly susceptible to loosening resulting from jarring and vibration. After repeated tightening and removal, however, the screws were quite likely to come loose during the saddlery's everyday use. This may result in the loss of a very valuable ornament. Furthermore, removal required the use of a screwdriver, and access to the back side of the saddlery (the side nearest the animal). Forget the tool, and removal was impossible. Additionally, if the saddlery is on the horse, it is impossible to remove the ornament. Hence, the problem of security against theft remained unsolved. It was still necessary to secure the entire object, unless the laborious unscrewing and removal of multiple ornaments, with the attendant increase in susceptibility to in-use loss, and the subsequent restoration of the ornaments to the saddlery, was practiced.

Other, non-analogous arts afforded no solution to these problems. See Osteen, U.S. Pat. No. 3,561,066; Bostian, U.S. Pat. No. 2,514,834; Graff et al., U.S. Pat. No. 1,807,100; Colton, U.S. Pat. No. 100,728; and Thornell, European Patent Application No. 78300569.7 (Publication No. 0 001 916).

There existed a definite need in the art, particularly relating to the non-permanent fastening of articles of manufacture to equine saddlery, for novel fastening means. The optimum combination of properties for a releasably attachable article of manufacture and method for releasable attachment would comprise:

(1) An article incorporating releasable attachment means which do not pierce or penetrate the article's outwardmost face;

(2) The releasable attachment means would require no use of tools to attach or remove, simple hand placement and removal being sufficient. Once in place, however, the article would resist any loosening of attachment while in use;

(3) The releasable attachment means would not deteriorate in function through repeated attachment and detachment, such that susceptibility to loss during use would not increase;

(4) The article and releasable attachment means would in combination interact with the means in the environment to which they were secured and that environment itself to enhance fastening and resist loosening during use.

None of the methods and articles for effecting attachment of an article of manufacture to extant means in an environment provide this optimum combination of properties.

SUMMARY OF THE INVENTION

The present invention relates to an article of manufacture, combination and method of releasably attaching an article of manufacture to extant means in an environment, which may include means provided integrally or through second attachment means upon a second article of manufacture.

The articles of manufacture of the invention comprise:

at least two surfaces, one of said surfaces further comprising first means whereby said article may be releasably attached to extant means in the environment of intended attachment of said article, said extant means comprising outwardly extending bridging means, said first means comprising generally U-shaped resilient clip means having a first leg, a second leg, and a joint joining said legs, said first leg being secured to said surface of said article, said second leg extending rearwardly and downwardly from said surface and joint, at least one of said legs of said first means comprising detent means disposed so as to extend towards the other of said legs and in spaced relationship from said joint, whereby the interior space formed between said first and second legs is divided into at least two longitudinal portions extending substantially parallel to said surfaces, such that the portion between said joint and said detent means is of a longitudinal dimension so as to substantially mate with said extant means while effecting releasable attachment therewith.

The combination of the invention constitutes:

an article of manufacture, comprising at least two surfaces, one of said surfaces further comprising first releasable attachment means, and second attachment means, said first means comprising generally U-shaped resilient clip means having a first leg, a second leg, and a joint joining said legs, said first leg being secured to said surface of said article, said second leg extending rearwardly and downwardly from said surface and joint, at least one of said legs of said first means comprising detent means disposed so as to extend towards the other of said legs and in spaced relationship from said joint, whereby the interior space formed between said first and second legs is divided into at least two longitudinal portions extending substantially parallel to said surfaces, such that the portion between said joint and said detent means is of a longitudinal dimension so as to substantially mate with said second means while effecting releasable attachment therewith, said second means comprising outwardly extending bridging means.

The method of the invention comprises a process for releasably attaching a first article of manufacture to extant means in an environment, particularly a second article of manufacture, said first article of manufacture having on one surface thereof first releasable attachment means, said first means comprising generally U-shaped resilient clip means having a first leg, a second leg, and a joint joining said legs, said first leg being secured to said surface of said first article of manufacture, said second leg extending rearwardly and downwardly from said surface and joint, at least one of said legs of said first means comprising detent means disposed so as to extend towards the other of said legs and in spaced relationship from said joint, whereby the interior space formed between said first and second legs is divided into at least two longitudinal portions extending substantially parallel to said surfaces, such that the portion between said joint and said detent means is of a longitudinal dimension so as to substantially mate with second attachment means while effecting releasable attachment therewith, said second article of manufacture having on one surface thereof second attachment means comprising outwardly extending bridging means, comprising:

1. bringing the entrance of said first releasable means into initial contact with the bridging means of said second means, and 2. slidingly engaging said means to place said first and second means into substantially mating relationship, whereby said bridging means of second means engages and bears against said detent means to force said second leg to resiliently yield to said second means, while said bridging means of said second means remains in contact with said detent means, said first means thereby substantially mating with and frictionally gripping and retaining said second means.

The present invention overcomes the drawbacks of the prior art, by providing an article, combination and method of releasably attaching an article of manufacture to extant means is an environment wherein the releasable attachment means do not pierce or penetrate the article's outermost face; which requires no use of tools to attach or remove, simple hand placement and removal being sufficient; which resists loosening of attachment while in use; which does not deteriorate in function through repeated attachment and detachment, so as to increase susceptibility to loss during use; and which is capable of interaction with the means in the environment and that environment itself to enhance fastening and resist loosening during use.

Accordingly, it is an object of this invention to provide an improved method of releasably attaching an article of manufacture to extant means in an environment which provides releasable attachment without use of means which pierce or penetrate the article's outermost face, which requires no use of tools to attach or remove, and which does not deteriorate in function through repeated attachment and detachment.

It is a further object of this invention to provide an article of manufacture capable of effecting releasable attachment with extant means in an environment, particularly such articles as ornaments, emblems, embellishment and/or trim for use with equine saddlery.

It is another object of this invention to provide a novel combination of a first article of manufacture releasably attached to a second article of manufacture, particularly where the first article is an ornament, emblem, embellishment or trim for use with equine saddlery, and the second article is such saddlery.

Other objects and advantages of this invention will become apparent upon reading the following detailed description and appended claims.

BRIEF DESCRIPTION OF THE DRAWINGS

FIG. 1 is a plan view of an article of saddlery, a use environment, bearing the releasably attachable article of the invention.

FIG. 2 is a partial section view of the article of the invention in a use environment.

FIG. 3 is a cross-sectional view of the article of the invention in a use environment, taken along line 3—3 of FIG. 1.

FIG. 4 is a further cross-sectional view of the article of the invention in a use environment, taken along line 4—4 of FIG. 3.

FIG. 5 is an exploded view of the combination of the invention, illustrating the article of the invention and one embodiment of attachment means in a use environment.

DESCRIPTION OF THE PREFERRED EMBODIMENTS

Figure 6:
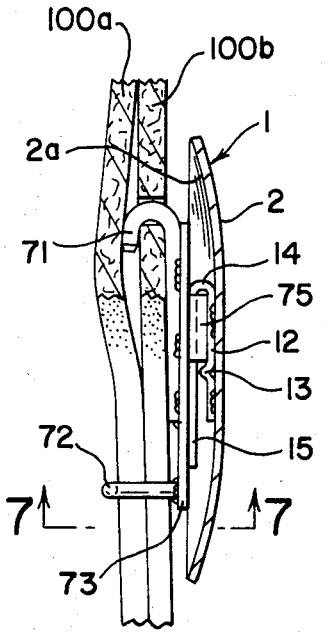
FIG. 6 is a side view in partial section of a first alternative embodiment of the extant means for attachment in a use environment.

The preferred article of the invention, when releasably attached to extant means in an environment, functions as an ornament or as part of an ornamentation group. FIG. 1 illustrates such as ornamentation group. Ornaments or trim members 6 and 7, as those of skill in the equine arts often refer to chased silver or other precious metal or base metal ornaments, are affixed to environment 5. Environment 5 is preferably a second article of manufacture or part of an article of manufacture, which may be made of any material. Where equine saddlery comprises environment 5, the material of choice is leather. The novel article of manufacture 1 of the invention is shown generally, as are U-shaped resilient clip means 11.

Clip means 11 is fastened, as will hereafter be described, to extant means in the environment 5. These extant means may include a buckle member or loop, such as a leather belt loop present upon a piece of harness, bridle, halter or other tack. Any appropriately dimensioned means comprising an outwardly sprung, outwardly raised or outwardly disposed bridge member will function to provide an anchorage for clip means 11. Preferably, the extant means comprise a leather loop of appropriate dimension making up an integral part of some base saddlery element, such as a loop present upon a saddle, belt, strap, harness, bridle, halter or the like. The extant means may also preferably comprise separate means mounted to the environment, which provide an outwardly extending bridge member and fastening means for said mounting, all as described hereafter.

U-shaped resilient clip means 11 are preferably constructed of a strong yet yieldable resilient material such as spring steel or spring plastic of suitable characteristics, to provide secure yet yieldable attachment. Firm hand pressure is preferably required to attach and detach article 1 to the extant means. The resilient material characteristics, including thickness of the material, type of steel stock and the like, can be varied by one skilled in the art to secure the appropriate attach and detach properties.

The preferred article of manufacture of the invention is more particularly illustrated in FIGS. 2–5. Article 1 comprises an ornamental element have surfaces 2, 2*a*, which are substantially parallel. The outermost surface 2 comprises the ornamental face. The ornamentation may take any form capable of serving an ornamental or embellishing function. Particularly preferred is an ornamental surface 2 comprising a precious metal, such as silver, which may be chased, filigreed or mounted with gemstones, such as turquoise. The innermost or obverse surface 2*a* may comprise a base metal, a rigid plastic or other material. Article 1 may be made up of a lamination or composite of materials, one to provide surface 2, another to provide surface 2*a*.

Affixed by appropriate means to surface 2*a* is U-shaped resilient clip means 11. Clips means 11 in turn comprises a first leg 12, a second leg 15 and a joint 14 joining said legs. Clip means 11 may be formed by means known in the art from metal or plastic, as earlier described. First leg 12 of clip means 11 is affixed to surface 2*a* in an appropriate manner, such as by spot welding, use of adhesives or integral formation with that surface.

Detent 13 is provided in either first leg 12 or second leg 15. The detent 13 may comprise a full width, outwardly struck configuration such as illustrated in FIGS. 2, 3 and 5, or may comprise a pin or outwardly struck depression or indentation extending through less than the full width of leg 12 or leg 15. Irrespective of whether it is provided in first leg 12 or second leg 15, detent 13 is disposed so as to extend towards the other of said legs, into the interior of the U-shape formed by the legs and joint 14. Detent 13 thereby divides that interior space into at least two longitudinal portions, which extend substantially parallel to surfaces 2 and 2*a*. The space between detent 13 and joint 14 of the clip means 11 has dimension Y, the detent 13 being placed in said leg 12 so as to attain that dimension.

Dimension Y and hence the position of detent 13 is chosen in accordance with dimension X of the extant means present in the environment. Said extant means 10 comprises an outwardly extending bridging means, which may be integral to the environment or borne on and affixed to separate attachment means 4. As illustrated in FIGS. 2 and 4, dimensions X and Y (dimension X being denominated as the "mating dimension") have been chosen to effect an essentially perfect mating between clip means 11 and extant means 10 of the environment. The mating is essentially a male/female fit, as may be most readily seen in FIG. 3. In this optimal instance, dimension X is slightly less than dimension Y, and the mate is essentially perfect.

The mate need not to be identical to that illustrated in FIGS. 2–4, however. Releasable attachment may be operably effected at any point where dimension Y is slightly larger than, equal to or less than dimension X, save where Y is substantially zero. In optimal embodiments, dimension Y should be at least one half of the mating dimension X, to insure solid retention without danger of unwanted release. It is preferred that dimension Y should be at least one quarter of the mating dimension X for the same reasons.

If extant means 10 is not integrally formed in environment 5, a second means 4 may be provided, as illustrated in FIGS. 2–5. Attachment means 4 bear outwardly extending extant means 10, which are affixed thereto, said means 10 having width in the longitudinal direction (parallel to surfaces 2, 2*a*) of X, the mating dimension. In a preferred embodiment, means 4 has posts 22, 23, which are internally drilled and tapped. Screws 20*a*, 20*b* threadingly fit said posts 22, 23, and comprise a "Chicago post" fastening means. Posts 22, 23 may be dimensioned to any length appropriate to pass through environment 5, which may comprise a leather member of equine saddlery. Openings 30, 31 are pierced through material 5, and the material most preferably is incised as shown as 50 in FIG. 5. This allows means 4 to be mounted flush with the surface of environment 5, leaving only extant means 10 projecting above the surface as outwardly extending bridging means. The screws 20*a*, 20*b* need only be secured once, and may be fitted with appropriate thread compound and torqued so as to insure a permanent fastening.

To releasably attach article of manufacture 1 to environment 5, the entrance of U-shaped resilient clip means 11 is brought into initial contact with means 10. In terms of FIGS. 2–5, the leftmost portion of clip means 11, the entrance to the interior space formed between legs 12 and 15, is brought into contact with the rightmost portion of means 10, feeding means 11 into the bridged-over interior space formed by means 10. By sliding article 1 to the left, detent 13 is brought into contact with means 10. Further sliding action defeats detent 13, due to the resilient action of leg 15, and allows further sliding engagement of clip means 11 and means 10. Releasable attachment is completed when joint 14 substantially contacts means 10. At that point, detent 13 may still be in contact with the upper, outermost surface of means 10, or may be positioned as shown in FIGS. 2, 3, depending upon the ratio between mating dimension X and dimension Y.

As is best illustrated in FIGS. 3 and 4, an optimal embodiment of the invention provides a slightly convex shape to surfaces 2, 2*a* of article 1. This slightly curved shape is formed such that, when releasable attachment through completion of sliding engagement is effected, the periphery of lower edge 2*a*, contacts the outermost surface of environment 5. This contact maximizes the resistance of article 1 to inadvertant release or detachment from means 10 and environment (or second article) 5. The resilient nature of clip means 11 allows slight biasing in an outward direction during sliding engagement, to avoid the dragging of the peripheral edge of surface 2*a* across environment 5. This function may be optimized by placing detent 13 upon second leg 15.

The extant means 10 are preferably constructed completely of metal, when they are not integral to environment 5, although rigid plastic or equivalent materials may be utilized. Construction of the outwardly extending bridge member of metal is preferable in all such instances, even if the attachment means 4 is constructed of other materials.

Figure 7:
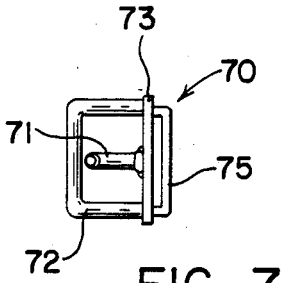
FIG. 7 is a cross-sectional view of the first alternative embodiment of the extant means, taken along line 7—7 of FIG. 6.

Other embodiments of extant environment attachment means are also contemplated by the invention. FIGS. 6 and 7 illustrate article of manufacture 1 of the invention in combination with bridle or halter buckle back means 70. Means 70 comprise a metal slide loop 72 through which the two straps 100*a* and 100*b* pass. Means 70 is secured to strap 100*b* by hook or tang means 71, which passes into and is secured by opening 101. Plate 73, to which loop 72 is fastened, also comprises on its opposite surface bridging means 75, equivalent to means 10 previously discussed. Releasable attachment is affected in a manner identical to that practiced with the embodiment of FIGS. 2–5.

Figure 8:
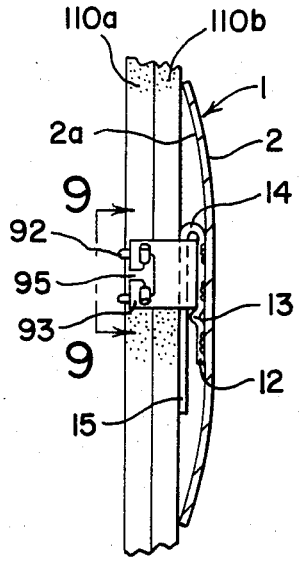
FIG. 8 is a side view in partial section of a second alternative embodiment of the extant means for attachment in a use environment.
Figure 9:
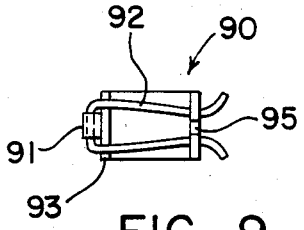
FIG. 9 is a plan view of the second alternative embodiment of the extant means, taken along line 9—9 of FIG. 8.

A second alternative embodiment of the extant environment attachment means is illustrated in FIGS. 8–9. There, article of manufacture 1 is secured to the environment by barrette-style means 90. Means 90 includes a rigid U-shaped base member 93, having hinge 91 through which spring-like wire means 92 are mounted and pivoted. The distal ends of wire 92 may be fitted through and releasably retained by throat structure 95. The barrette means 90 are secured about straps 110*a* and 110*b* by disengaging and pivoting wires 92 away from the open end of U-shaped member 93, fitting that member around the straps, and pivoting wire 92 in the opposite direction to close and re-engage throat 95.

Contrary to the FIGS. 2–5 and FIGS. 6–7 embodiments, the barrette means 90 comprises no element 10 or 75, which projects outwardly from a base or plate to form a bridge structure. Instead, U-shaped member 93 is dimensioned so that it forms a bridge between the overmost surface of strap 110*b* and its innermost surface, leaving a space into which second leg 15 of the clip means may be introduced and slidingly engaged in a manner identical to the previously described embodiments.

Other embodiments of the extant means for releasable attachment to the environment include corner plate hardware means and breast collar hardware means, well-known to one skilled in the saddlery arts.

While the figures illustrate "Chicago post", post and screw fittings as comprised by each embodiment of the extant means for releasable attachment to the environment, any other of the well-known permanent fastening means may be utilized. Particularly contemplated by the invention are post and rivet, post and split rivet, rivet and split rivet fastening means, or combinations thereof to secure the extant means to the environment.

The preferred second article of manufacture or environment of the method and combination of the invention is equine saddlery, particularly fashioned of leather or equivalent natural or synthetic materials. The invention is of particular utility in releasably fastening articles of manufacture to a second article of manufacture selected from the group consisting of an equine saddle, reins, bridle, harness, halter and breast collar. Of course, any combination or multiple of those items of saddlery may be used as part of the combination of the invention, as well as the method.

While particular embodiments of the invention, and the best mode contemplated by the inventor for carrying out the invention, have been shown, it will be understood, of course, that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention.

We claim:

1. An article of manufacture comprising at least two surfaces, one of said surfaces further comprising first means whereby said article may be releasably attached to extant means in the environment of intended attachment of said article, said first means comprising generally U-shaped resilient clip means having a first leg, a second leg, and a joint joining said legs, said first leg being secured to said surface of said article, said second leg extending rearwardly and downwardly from said surface and joint, said extant means comprising outwardly extending bridging means, at least one of said legs of said first means comprising detent means disposed so as to extend towards the other of said legs and in spaced relationship from said joint, whereby the interior space formed between said first and second legs is divided into at least two longitudinal portions extending substantially parallel to said surfaces, such that the portion between said joint and said detent means is of a longitudinal dimension so as to substantially mate with said extant means while effecting releasable attachment therewith.

2. The article of claim 1 wherein said longitudinal dimension of said portion between said joint and said detent means of said clip is greater than the mating dimension of said extant means.

3. The article of claim 1 wherein said longitudinal dimension of said portion between said joint and said detent means of said clip is greater than one half of the mating dimension of said extant means.

4. The article of claim 1 wherein said surfaces of said article comprise a first ornamental surface and a second obverse surface, said first means being secured to said obverse surface.

5. The article of claim 4 wherein said first ornamental surface comprises a precious metal.

6. In combination, an article of manufacture, comprising at least two surfaces, one of said surfaces further comprising first releasable attachment means, and second attachment means, said first means comprising generally U-shaped resilient clip means having a first leg, a second leg, and a joint joining said legs, said first leg being secured to said surface of said article, said second leg extending rearwardly and downwardly from said surface and joint, said second means comprising outwardly extending bridging means, at least one of said legs of said first means comprising detent means disposed so as to extend towards the other of said legs and in spaced relationship from said joint, whereby the interior space formed between said first and second legs is divided into at least two longitudinal portions extending substantially parallel to said surfaces, such that the portion between said joint and said detent means is of a longitudinal dimension so as to substantially mate with said second means while effecting releasable attachment therewith.

7. The combination of claim 6 wherein said second means is integral to a second article of manufacture.

8. The combination of claim 7 wherein said second article of manufacture is selected from the group consisting of an equine saddle, reins, bridle, harness, halter and breast collar.

9. The combination of claim 6 wherein said second means comprises an outwardly extending bridge member and fastening means, whereby said second means is fastened to a second article of manufacture.

10. The combination of claim 9 wherein said second article of manufacture is selected from the group consisting of an equine saddle, reins, bridle, harness, halter and breast collar.

11. The combination of claims 7, 8, 9 or 10 wherein at least the periphery of said surface of said first article of manufacture comprising said first releasable attachment means directly contacts the surface of said second article of manufacture comprising said second attachment means.

12. The combination of claim 6 wherein said longitudinal dimension of said portion between said joint and said detent means of said clip is greater than the mating dimension of said second means.

13. The combination of claim 6 wherein said longitudinal dimension of said portion between said joint and said detent means of said clip is greater than one half of the mating dimension of said second means.

14. The combination of claims 6, 8 or 10 wherein said surfaces of said article comprise a first ornamental surface and a second obverse surface, said first means being secured to said obverse surface.

15. The combination of claim 14 wherein said first ornamental surface comprises a precious metal.

16. A method of releasably attaching a first article of manufacture to a second article of manufacture, said first article of manufacture having on one surface thereof first releasable attachment means, said first means comprising generally U-shaped resilient clip means having a first leg, a second leg, and a joint joining said legs, said first leg being secured to said surface of said first article of manufacture, said second leg extending rearwardly and downwardly from said surface and joint, at least one of said legs of said first means comprising detent means disposed so as to extend towards the other of said legs and in spaced relationship from said joint, whereby the interior space formed between said first and second legs is divided into at least two longitudinal portions extending substantially parallel to said surfaces, such that the portion between said joint and said detent means is of a longitudinal dimension so as to substantially mate with second attachment means while effecting releasable attachment therewith, said second article of manufacture having on one surface thereof second attachment means comprising outwardly extending bridging means, comprising:

1. bringing the entrance of said first releasable means into initial contact with the bridging means of said second means, and
2. slidingly engaging said means to place said first and second means into substantially mating relationship, whereby said bridging means of second means engages and bears against said detent means to force said second leg to resiliently yield to said second means, while said bridging means of second means remains in contact with said detent means, said first means thereby substantially mating with and frictionally gripping and retaining said second means.

17. The method of claim 16 wherein said first article of manufacture comprises ornamental means.

18. The method of claims 16 or 17 wherein said second article of manufacture is selected from the group consisting of an equine saddle, reins, bridle, harness, halter and breast collar.

* * * * *